US007183929B1

(12) United States Patent
Antebi et al.

(10) Patent No.: US 7,183,929 B1
(45) Date of Patent: Feb. 27, 2007

(54) CONTROL OF TOYS AND DEVICES BY SOUNDS

(75) Inventors: Amit Antebi, Ramat-Gan (IL); Alon Atsmon, Yehud (IL)

(73) Assignee: Beep Card Inc., Tel-Aviv (IL)

( * ) Notice: Subject to any disclaimer, the term of this patent is extended or adjusted under 35 U.S.C. 154(b) by 0 days.

(21) Appl. No.: 09/743,065

(22) PCT Filed: Sep. 16, 1998

(86) PCT No.: PCT/IL98/00450

§ 371 (c)(1),
(2), (4) Date: Jan. 3, 2001

(87) PCT Pub. No.: WO00/01456

PCT Pub. Date: Jan. 13, 2000

(30) Foreign Application Priority Data

Jul. 6, 1998 (IL) ..... 125221

(51) Int. Cl.
*G08B 23/00* (2006.01)

(52) U.S. Cl. ..... 340/573.1; 340/573.3; 340/573.5; 340/573.7; 340/384.1

(58) Field of Classification Search ..... 340/573.1, 340/573.3, 574.4, 573.5, 573.7, 505, 506, 340/330, 384.1; 446/175, 303; 473/212; 348/121

See application file for complete search history.

(56) References Cited

U.S. PATENT DOCUMENTS

| | | | | |
|---|---|---|---|---|
| 2,990,646 | A | 7/1961 | Berger | 446/175 |
| 4,207,696 | A | 6/1980 | Hyman et al. | 40/473 |
| 4,231,184 | A | 11/1980 | Corris et al. | 446/175 |
| 4,264,978 | A | 4/1981 | Whidden | 455/67.12 |
| 4,390,877 | A | 6/1983 | Curran | 340/825.72 |
| 4,637,007 | A | 1/1987 | Sakurai | 369/67 |
| 4,640,034 | A | 2/1987 | Zisholtz | 40/455 |
| 4,673,371 | A | 6/1987 | Furukawa | 446/175 |
| 4,682,370 | A | 7/1987 | Matthews | 455/166.2 |
| 4,696,653 | A * | 9/1987 | McKeefery | 446/175 |
| 4,717,364 | A | 1/1988 | Furukawa | 446/175 |
| 4,840,602 | A | 6/1989 | Rose | 446/175 |
| 4,857,030 | A | 8/1989 | Rose | 446/303 |

(Continued)

FOREIGN PATENT DOCUMENTS

GB 2 236 258 4/1991

(Continued)

OTHER PUBLICATIONS

Encotone, Ltd.-Corporate Background; 2 pages; Retrieved from the Internet on Feb. 2, 1999 <http://www.encotone.com/html/comp_def.html>.

(Continued)

*Primary Examiner*—Van T. Trieu
(74) *Attorney, Agent, or Firm*—Ehrlich & Fenster

(57) ABSTRACT

A method of controlling at least one device by incidental sound produced by a living creature and including: attaching a sound-maker to a living creature so that the natural movements of the living creature will cause the sound-maker to emit a sound; receiving the sound by at least one device; and responding by some physical response to the sound, by the at least one device.

68 Claims, 12 Drawing Sheets

U.S. PATENT DOCUMENTS

| | | | | |
|---|---|---|---|---|
| 4,935,907 | A | 6/1990 | Friedman | 367/118 |
| 4,961,229 | A | 10/1990 | Takahashi | |
| 4,973,286 | A | 11/1990 | Davison | 446/175 |
| 4,978,840 | A | 12/1990 | Anegawa | 235/492 |
| 4,984,380 | A | 1/1991 | Anderson | 446/175 |
| 5,032,099 | A | 7/1991 | Chan | 446/175 |
| 5,085,610 | A | 2/1992 | Engel et al. | 446/175 |
| 5,176,560 | A | 1/1993 | Wetherell et al. | 446/175 |
| 5,191,615 | A | 3/1993 | Aldava et al. | 381/2 |
| 5,209,695 | A | 5/1993 | Rothschild | 446/175 |
| 5,241,160 | A | 8/1993 | Bashan et al. | 235/380 |
| 5,280,527 | A | 1/1994 | Gullman et al. | 713/184 |
| 5,289,273 | A * | 2/1994 | Lang | 348/121 |
| 5,307,051 | A | 4/1994 | Sedlmayr | 340/573.1 |
| 5,314,336 | A | 5/1994 | Diamond et al. | 434/169 |
| 5,324,038 | A * | 6/1994 | Sasser | 473/212 |
| 5,356,326 | A | 10/1994 | Ting | 446/175 |
| 5,407,376 | A | 4/1995 | Avital et al. | 446/175 |
| 5,423,073 | A | 6/1995 | Ogawa | 455/70 |
| H1469 | H | 8/1995 | Simonoff | 341/176 |
| 5,452,901 | A | 9/1995 | Nakada et al. | 446/454 |
| 5,583,933 | A | 12/1996 | Mark | 379/357.04 |
| 5,606,732 | A | 2/1997 | Vignone, Sr. | 455/269 |
| 5,629,867 | A | 5/1997 | Goldman | 381/77 |
| 5,635,701 | A | 6/1997 | Gloton | 235/486 |
| 5,638,047 | A | 6/1997 | Orloff et al. | 340/539.16 |
| 5,646,907 | A | 7/1997 | Maccabee | 367/93 |
| 5,647,787 | A | 7/1997 | Raviv et al. | 446/175 |
| 5,655,945 | A | 8/1997 | Jani | 446/175 |
| 5,697,829 | A | 12/1997 | Chainani et al. | 446/436 |
| 5,708,853 | A | 1/1998 | Sanemitsu | 710/73 |
| 5,717,168 | A | 2/1998 | DeBuisser et al. | 178/18.04 |
| 5,752,880 | A | 5/1998 | Gabai et al. | 463/1 |
| 5,763,862 | A | 6/1998 | Jachimowicz et al. | 235/380 |
| 5,764,512 | A | 6/1998 | Michel et al. | 700/94 |
| 5,764,763 | A | 6/1998 | Jensen et al. | 380/253 |
| 5,764,900 | A | 6/1998 | Morris et al. | 709/203 |
| 5,774,791 | A | 6/1998 | Strohallen et al. | 455/41.1 |
| 5,778,187 | A | 7/1998 | Monteiro et al. | 709/231 |
| 5,786,764 | A | 7/1998 | Engellenner | 340/572.4 |
| 5,789,733 | A | 8/1998 | Jachimowicz et al. | 235/492 |
| 5,800,243 | A | 9/1998 | Berman | 446/420 |
| 5,809,245 | A | 9/1998 | Zenda | 709/217 |
| 5,815,020 | A | 9/1998 | Allen et al. | 327/255 |
| 5,847,752 | A | 12/1998 | Sebestyen | 348/14.12 |
| 5,859,913 | A | 1/1999 | Goreta et al. | 380/52 |
| 5,864,794 | A | 1/1999 | Tasaki | 704/200.1 |
| 5,870,155 | A | 2/1999 | Erlin | 348/734 |
| 5,921,674 | A | 7/1999 | Koczi | 362/800 |
| 5,963,643 | A | 10/1999 | Goreta et al. | 713/184 |
| 6,018,641 | A | 1/2000 | Tsubouchi et al. | 340/10.3 |
| 6,019,285 | A | 2/2000 | Isobe et al. | 235/384 |
| 6,089,942 | A | 7/2000 | Chan | 446/175 |
| 6,110,000 | A | 8/2000 | Ting | 446/302 |
| 6,244,260 | B1 | 6/2001 | Ragoza et al. | 124/34 |
| 6,309,275 | B1 | 10/2001 | Fong et al. | 446/297 |
| 6,377,670 | B1 | 4/2002 | Rosset et al. | 379/144.05 |
| 6,380,844 | B2 | 4/2002 | Pelekis | 340/5.8 |
| 6,389,055 | B1 | 5/2002 | August et al. | 375/130 |
| 6,445,780 | B1 | 9/2002 | Rosset et al. | 379/114.1 |

FOREIGN PATENT DOCUMENTS

| | | |
|---|---|---|
| WO | WO 93/11619 | 6/1993 |
| WO | WO 93/21720 | 10/1993 |
| WO | WO 94/17498 | 8/1994 |
| WO | WO 96/10880 | 4/1996 |
| WO | WO 97/15899 | 5/1997 |
| WO | WO 97/16049 | 5/1997 |
| WO | WO 98/57474 | 12/1998 |
| WO | WO 99/23804 | 5/1999 |

OTHER PUBLICATIONS

TeleID™ Major Applications; Encotone Ltd.; 3 pages; Retrieved from the Internet on Feb. 2, 1999 <http://www.encotone.com/html/app_def.html>.

TeleID™ System; Encotone Ltd.; 8 pages; Retrieved from the Internet on Feb. 2, 1999 <http://www.encotone.com/html/tech_def.html>.

* cited by examiner

CONTROL OF TOYS AND DEVICES BY SOUNDS

RELATED APPLICATIONS

This application is a US national filing of PCT Application PCT/IL98/00450, filed Sep. 16, 1998, which claims priority from Israel Patent Application No. IL 125,221, filed Jul. 6, 1998.

FIELD OF INVENTION

The present invention relates generally to the control of toys and devices by sounds, as well as to the control of toys and devices by incidental sounds, that is by sounds whose generation is subordinate to some other action, or by sounds whose generation accompanies some other action.

BACKGROUND OF THE INVENTION

Devices that perform certain functions in response to sounds such as singing, whistling, ringing bells or voicing commands are known in the art. These devices are used, for example, in toys and appliances.

U.S. Pat. No. 5,209,695, "Sound Controllable Apparatus Particularly Useful in Controlling Toys and Robots", the disclosure of which is incorporated herein by reference, describes an apparatus for controlling a device according to different sound commands. The apparatus comprises a microphone, a processor and a control system. The apparatus is capable of interpreting different commands, which may be a word, combinations of words, beeps, hand-claps and whistles.

U.S. Pat. No. 4,673,371, "Robot-Like Toy Vehicle", the disclosure of which is incorporated herein by reference, describes a robot-like toy that reverses the direction of its movement in response to a loud sound, such as a hand clap, or a call.

U.S. Pat. No. 4,231,184, "Remote-Control Doll Assembly", the disclosure of which is incorporated herein by reference, describes a doll that raises its arms and cries in responds to sounds made by squeezing a toy baby bottle or by squeezing a pressure-sensitive rattle.

U.S. Pat. No. 4,637,007, "Toy having a Melody-Making Mechanism of a Sound-Detection Type", the disclosure of which is incorporated herein by reference, describes a toy such as a stuffed doll, having a melody-making mechanism which responds to external sounds such as human voice or a hand clap.

These sound-control devices rely on sounds generated by a specific action of the user, for example, by pronouncing a word, clapping hands or squeezing a pressure-sensitive rattle.

U.S. Pat. No. 4,973,286, "Multiple Activation Crib Toy", the disclosure of which is incorporated herein by reference, describes a crib toy that provides musical output and predetermined motions of a plurality of cartoon-like figures. The crib toy contains several noise-producing apparatuses (a rattle, a horn button and a center button) that are an integral part of the crib toy. The crib toy is activated by sounds. The sounds may be ambient sounds or specific sounds produced by an infant manipulating the noise-producing apparatuses.

U.S. Pat. No. 4,207,696, "Sound Activated Mobile", the disclosure of which is incorporated herein by reference, describes a mobile that is activated by the sounds in its vicinity.

U.S. Pat. No. 4,640,034, "Mobile for Infants", the disclosure of which is incorporated herein by reference, describes a sound-producing mobile and cassette player that are activated by sounds from the crib, and respond with comforting voices via a loudspeaker and movement of the mobile.

These sound-control devices rely on ambient sound which may come from the baby, but may come from other sources as well, so their response is not necessarily specific to the baby.

Toys that respond to other toys are described for example in the above described U.S. Pat. No. 4,231,184, "Remote Control Doll Assembly" and U.S. Pat. No. 4,973,286, "Multiple Activation Crib Toy". U.S. Pat. No. 5,314,336, "Toy and Method Providing Audio Output Representative of Message Optically Sensed by the toy", the disclosure of which is incorporated herein by reference describes a toy capable of optically detecting and recognizing specific markings on objects, and articulating a word, a phrase or a sentence in response to the markings. In this way the toy may "read" and "speak". The markings may be visible codes, invisible codes or holograms.

Toys and devices that respond to sounds by body motion are described for example in U.S. Pat. No. 4,984,380, "Body-Motion Activated Crib Mobile", the disclosure of which is incorporated herein by reference, describes a mobile that is activated by an infant's motion, utilizing a passive infrared sensor detects the body motion.

Toys that respond to a direction a sound are described in U.S. Pat. No. 5,407,376, "Voice-Responsive Doll eye Mechanism", the disclosure of which is incorporated herein by reference, which describes a doll having a mechanism that provides eye rotation when a child speaks to the doll, to simulate a human response.

SUMMARY OF THE INVENTION

One aspect of some preferred embodiments of the present invention is to control toys and electrical devices by incidental sounds produced by a sound maker that is attached to a person, a pet and/or devices physically coupled to a person, such as clothes or a wheelchair.

In preferred embodiments of the invention, a sound maker is worn by a person or a pet, or is attached to an article of clothing of the person. As the person (or pet) moves, sounds incidental to the movement are generated. The responding toy or device has a microphone and appropriate circuitry to respond to the incidental sounds. Examples are, an infant wearing a rattle bracelet may operate a mobile, an invalid wearing a rattle pendant may operate lights and electrical appliances such as a radio, and a fan, a pet wearing a rattle collar may operate an electric door lock, or an electric water faucet.

An aspect of some preferred embodiments of the present invention is to provide toys and devices that respond to the direction of a non-human sound source, or to some other direction with respect to the direction of a sound source (wherein the sound may or may not be incidental).

In preferred embodiments of this aspect, the responding toy or device has a stereophonic receiver (comprising two microphones) and appropriate circuitry to discern the direction of a sound source and to respond in proper manner Alternatively, the responding toy or device has a receiver which comprises a single microphone that has an angular-dependent frequency response, so that sounds from different directions are received differently. For example, a toy puppy may respond to a sound source by turning and looking in the direction of the sound source. Alternatively or additionally, the toy puppy may also walk towards the sound source and/or change its direction of motion. In another example, a toy car may wheel over towards the sound source. Alternatively or additionally, the toy may respond to the sound by changing an angle of at least one of its wheels. Alternatively or additionally, the toy may respond to the sound source with a different logic, for example, turn away.

An aspect of some preferred embodiments of the present invention is to provide toys and devices that respond responsive to a distance of the sound source. In one example, a toy responds only to sounds within a specific distance, or respond differently to sound sources from different distances (wherein the sounds may or may not be incidental).

In a preferred embodiment of the invention, the responding toy or device include a range finder. For example, a radio and a fan will be turned on only when an invalid wearing a sound maker is within a specific range.

An aspect of some preferred embodiments of the present invention is to provide toys and devices that respond responsive to a change of direction and/or distance and/or relative or absolute position of the sound source. In a preferred embodiment of the invention, the response may depend on the magnitude of the change and/or on the polarity of the change, for example, advancing/retreating (wherein the sounds may or may not be incidental).

In preferred embodiments of this aspect, the responding toy or device has appropriate circuitry to determine whether a sound source is approaching or moving away by the different levels of amplitude with time. For example, as the sound source approaches, the sound amplitude increases. Alternatively or additionally, the responding toy or device has appropriate circuitry that relies on the Doppler effect of the sound frequency to determine whether a sound source is approaching or moving away. For example, a doll may say, "Hellos" when a toddler wearing a rattle bracelet approaches, and "See you later," when he walks away. An "I-am-always-behind-you" puppy may follow close behind the toddler. A "chase-me" ball may roll away from the toddler. In a preferred embodiment of the invention, an incidental sound source is constructed to provide a substantially constant amplitude and/or frequency spectrum substantially independent of the cause for sound generation.

An aspect of some preferred embodiments of the present invention is to provide toys and devices that respond differently to different amplitudes of sound (wherein the sound may or may not be incidental).

In preferred embodiments of this aspect, the responding toy or device has several amplitude filters and appropriate circuitry to respond in kind to different amplitude levels. For example, a mobile or a toy computer may play a loud tune in response to a loud rattle and a soft tune in response to a soft rattle.

An aspect of some preferred embodiments of the present invention is to provide toys and devices that respond differently to different pitches of sound wherein the wavelength of the sound is known or wherein the sound have a known wavelength spectrum. (The sound may or may not be incidental).

In preferred embodiments of this aspect, the responding toy or device has a frequency band filter allowing only a particular frequency band to control the toy or the device. Alternatively, the toys and devices have a microprocessor that analyzes the incoming sound and compares it with an expected sound spectrum of the toy or device. For example, a mobile will respond to the rattle bracelet on the infant's wrist but not to ambient sounds nor to the sounds of the infant crying.

An aspect of some preferred embodiments of the present invention is to provide toys and devices that respond differently to different rates of sound production, such as different rates of rattling (wherein the sound may or may not be incidental).

In preferred embodiments of this aspect, the responding toy or device has a appropriate circuitry that analyzes the rate of sound production and responds in kind. For example, a mobile may play a fast tune in response to a fast rate of rattle and a slow tune in response to a slow rate of rattle, a "chase-me" ball will roll away faster as a toddler wearing a rattle bracelet chases it faster.

An aspect of some preferred embodiments of the present invention is to provide a plurality of toys and devices all controlled by a single sound maker (wherein the sound may or may not be incidental).

In preferred embodiments of this aspect, a small child or an invalid may control several devices such as lights, an air conditioner or a music system with one sound maker.

An aspect of some preferred embodiments of the present invention is to provide a plurality of toys and devices and a plurality of sound makers, each having a unique sound, wherein there is a one-to-one correspondence between the toys and devices on the one hand and the sound makers on the other, so that each toy or device responds only to the specific sound of its corresponding sound maker (wherein the sound may or may not be incidental).

In preferred embodiments of this aspect, a small child may entertain himself with a plurality of sound makers, and a plurality of corresponding toys and devices will respond to the sounds in a respective manner. For example, an arrangement may comprise a plurality of squeaking, toy, baby animals, and a plurality of corresponding, toy, mother animals, each with a microphone and a filter band so as to respond only to the squeaking sounds of its own toy baby. As a child squeaks any of the toy baby animals, a toy mother animal calls out for her baby. Alternatively, the toy mother animal may also have a motor and turns to face its toy baby, or advance towards it.

An aspect of some preferred embodiments of the present invention to provide a plurality of sound makers, each having a unique sound, to control different functions of a single toy or device (wherein the sound may or may not be incidental).

In preferred embodiments of this aspect, a small child may entertain himself with a plurality of sound makers, and a multi-functional toy will respond. For example, an arrangement may comprise a toy computer and a plurality of sound makers that operate as function keys. In a preferred embodiment of the invention, the multi-function toy comprises a computer game (e.g., space invaders), wherein controllable elements of the game are controlled responsive to the direction, amplitude, distance and/or changes therein. In one example, the motion of a spaceship is dependent on the direction and/or speed of motion of the sound source. the parameters of the sound source may be determined using a one or more microphones, as described above. In a preferred embodiment of the invention, an arrangement may comprise a toy computer and a plurality of squeaking toy animals. As a child squeaks any of the toy animals, the toy computer pronounces the name of the animal An advantage to controlling toys and devices by sounds is that there is no need to resort to electromagnetic radiation for remote control especially where small children are involved.

In a preferred embodiment of the invention, the toy utilizes a microcontroller to analyze received sounds. Thus, several different sounds can be responded to at a same manufacturing as responding to a single sound.

There is thus provided in accordance with a preferred embodiment of the invention, a method of controlling at least one device by incidental sound produced by a living creature and including:

attaching a sound-maker to a living creature so that the natural movements of the living creature will cause the sound-maker to emit a sound;

receiving the sound by at least one device; and responding by some physical response to the sound, by the at least one device.

Preferably, receiving comprises stereophonically receiving and including:

analyzing the direction of the incoming sound, wherein responding includes responding to a specific direction in relation to the direction of the received sound.

Alternatively or additionally, receiving comprises differentially receiving sounds coming from different directions and including:

analyzing the direction of the incoming sound, wherein responding includes responding to a specific direction in relation to the direction of the received sound.

There is also provided in accordance with a preferred embodiment of the invention, a method of controlling at least one device by sound and including:

generating a sound by a non-human sound-maker;

stereophonically receiving the sound by at least one device;

analyzing the direction of the received sound; and responding, by the at least one device to a specific direction in relation to the direction of the received sound.

There is also provided in accordance with a preferred embodiment of the invention, a method of controlling at least one device by sound and including:

generating a sound by a non-human sound-maker;

differentially receiving sounds coming from different directions;

analyzing the direction of the received sound; and responding, by the at least one device to a specific direction in relation to the direction of the received sound.

In a preferred embodiment of the invention, a living creature causes the sound to be generated.

In a preferred embodiment of the invention, the method includes analyzing whether the source of the sound is approaching or moving away, wherein responding includes responding differently to a sound source that is approaching and to a sound source that is moving away.

There is also provided in accordance with a preferred embodiment of the invention, a method of controlling at least one device by sound and including:

generating a sound by a sound-maker;

receiving the sound by at least one device;

analyzing whether the source of the sound is approaching or moving away; and responding differently by the at least one device to a sound source that is approaching and to a sound source that is moving away.

Preferably, wherein a living creature causes the sound to be generated.

In a preferred embodiment of the invention, the method includes analyzing the distance from at least one device to the sound-maker, wherein responding includes responding differently to sound sources from different distances.

There is also provided in accordance with a preferred embodiment of the invention, a method of controlling at least one device by sound and including:

generating a sound by a sound-maker;

receiving the sound by at least one device;

analyzing the distance from at least one device to the sound-maker; and responding differently by the at least one device to sound sources from different distances.

Preferably, a living creature causes the sound to be generated.

In a preferred embodiment of the invention, the method includes analyzing the sound for amplitude, wherein responding includes responding differently to different amplitudes.

There is also provided in accordance with a preferred embodiment of the invention, a method of controlling at least one device by sound and including:

generating a sound by a sound-maker;

receiving the sound by at least one device;

analyzing the sound for amplitude; and responding differently by the at least one device to different amplitudes.

Preferably, a living creature causes the sound to be generated.

In a preferred embodiment of the invention, the sound is characteristic of the sound maker and wherein the device responds only to the characteristic sound. Alternatively or additionally, the method includes analyzing the sound for pitch; wherein responding includes responding differently to different pitches.

There is also provided in accordance with a preferred embodiment of the invention, a method of controlling at least one device by sound and including: generating a characteristic sound by a sound-maker;

receiving the characteristic sound by at least one device;

analyzing the characteristic sound for pitch; and responding differently by the at least one device to different pitches.

Preferably, a living creature causes the sound to be generated.

In a preferred embodiment of the invention, the method includes analyzing the sound for sound-production rate; wherein responding includes responding differently to different rates.

There is also provided in accordance with a preferred embodiment of the invention, a method of controlling at least one device by sound and including:

generating a sound by a sound-maker;

receiving the sound by at least one device;

analyzing the sound for sound-production rate; and responding differently by the at least one device to different rates.

Preferably, a living creature causes the sound to be generated.

In a preferred embodiment of the invention, at least one device comprises at least one toy. Alternatively or additionally, at least one device comprises at least one electrical appliance. Alternatively or additionally, at least one device comprises at least one lighting device. Alternatively or additionally, at least one device comprises a plurality of devices.

In a preferred embodiment of the invention, the method comprises providing a plurality of devices and a plurality of sound makers, wherein there is a one to one correspondence between the sounds produced by the sound makers and the devices and including:

generating a sound of specific characteristics by one of the plurality of sound makers;

receiving the sound by the plurality of devices;

analyzing the sound characteristics by the plurality of devices; and responding only by the corresponding device to the specific sound characteristics of its sound maker.

There is also provided in accordance with a preferred embodiment of the invention, a method of controlling a plurality of devices by a plurality of sound makers, wherein there is a one to one correspondence between the sound makers and the devices and including:

generating a sound of specific characteristics by one of the plurality of sound makers;

receiving the sound by the plurality of devices;

analyzing the sound characteristics by the plurality of devices; and responding only by the corresponding device to the specific sound characteristics of its corresponding sound maker.

Preferably, a living creature causes the sound to be generated.

In a preferred embodiment of the invention, the living creature is a child, preferably a child lacking fine motor control. Alternatively or additionally, the living creature is an infant lacking fine motor control. Alternatively or additionally, the living creature is an invalid. Alternatively or additionally, the living creature is an animal.

In a preferred embodiment of the invention, the method comprises:

providing a plurality of sound-makers, each generating a characteristic sound when activated and a single multifunctional device;

generating a sound of specific characteristics by one of the plurality of sound makers;

receiving the sound by the device;

analyzing the sound characteristics by the device; and responding by the device with a specific function to the specific sound characteristics of the sound maker.

In a preferred embodiment of the invention, responding comprises producing an audio output. Alternatively or additionally, responding comprises producing a light display. Alternatively or additionally, responding comprises producing a response on a computer screen. Alternatively or additionally, receiving comprises sensing the direction of the sound source and comprising:

controlling at least one element in a computer game responsive to said received sounds.

In a preferred embodiment of the invention, controlling comprises moving the element responsive to the sensed direction. Alternatively or additionally, responding comprises generating motion on the device. Preferably, generating motion comprises turning a head. Alternatively or additionally, moving comprises moving eyes. Alternatively or additionally, moving comprises moving a nose. Alternatively or additionally, moving comprises moving ears. Alternatively or additionally, moving comprises moving a mouth.

In a preferred embodiment of the invention, responding comprises moving the device. Preferably, moving comprises moving on limbs. Alternatively or additionally, moving comprises moving on wheels. Alternatively or additionally, moving comprises moving on treads. Alternatively or additionally, moving comprises moving at a predetermined angular orientation. Alternatively or additionally, moving comprises moving at a variable angle.

In a preferred embodiment of the invention, the sound comprises ultrasound. Alternatively or additionally, the sound comprises infra-sound.

There is also provided in accordance with a preferred embodiment of the invention, apparatus comprising:

a sound-maker which produces a sound when moved;

means of attaching the sound-maker to a living creature so that the natural movements of the living creature will cause the sound-maker to emit said sound; and at least one device that receives the sound and produces a physical response, responsive only to the sound.

Preferably, the sound maker produces a characteristic sound and wherein the device responds only to the characteristic sound. Alternatively or additionally, the at least one device comprises:

a sound receiver that receives the sound and produces at least one sound signal responsive thereto;

a sound analyzer, that receives the at least one sound signal and determines if a physical response should be made; and a responsive element that performs the physical response, responsive to the determination.

Preferably, the sound receiver is a stereophonic receiver;

the sound analyzer determines the direction of the sound from the at least one signal; and the responsive element responds relative to a specific direction with respect to the determined direction of the sound source.

Alternatively or additionally, the sound receiver is a receiver having an angular dependence;

the sound analyzer determines the direction of the sound from the at least one signal; and the responsive element responds relative to a specific direction with respect to the determined direction of the sound source.

There is also provided in accordance with a preferred embodiment of the invention, apparatus comprising:

a sound-maker which produces a sound when moved;

at least one device comprising:

a stereophonic sound receiver that receives the sound and produces at least one sound signal responsive thereto;

a sound analyzer, that receives the at least one sound signal and determines the direction of the sound and whether a response should be made to the sound; and a responsive element that performs a physical response, responsive to the determination.

There is also provided in accordance with a preferred embodiment of the invention, apparatus comprising:

a sound-maker which produces a sound when moved;

at least one device comprising:

a sound receiver comprising a microphone having an angular dependence that receives the sound and produces at least one sound signal responsive thereto;

a sound analyzer, that receives the at least one sound signal and determines the direction of the sound and whether a response should be made to the sound; and a responsive element that performs a physical response, responsive to the determination.

In a preferred embodiment of the invention, the responsive element causes a response related to the determined direction.

In a preferred embodiment of the invention, the sound analyzer determines whether the sound maker is approaching or receding from the device; and the responsive element performs a physical response dependent on the determination.

There is also provided in accordance with a preferred embodiment of the invention. apparatus comprising:

a sound-maker which produces a sound when moved;

at least one device comprising:

a sound receiver that receives the sound and produces at least one sound signal responsive thereto;

a sound analyzer, that receives the at least one sound signal and determines whether the sound maker is approaching or receding from the device and whether a response should be made to the sound; and a responsive element that performs a physical response, responsive to the determination.

Preferably, the response is different depending on whether the source is determined to be approaching or receding.

In a preferred embodiment of the invention, the sound analyzer determines whether a sound source is approaching or receding by the Doppler effect on the sound frequency. Alternatively or additionally, the sound analyzer determines whether a sound source is approaching or moving away by a change in amplitude of the sound with time.

In a preferred embodiment of the invention, at least one device comprises a range finder which determines the distance to the sound source, where the response of the device is dependent on the determined distance.

There is also provided in accordance with a preferred embodiment of the invention, apparatus comprising:

a sound-maker which produces a sound when moved;

at least one device comprising:

a sound receiver that receives the sound and produces at least one sound signal responsive thereto;

a range finder that determines the distance to the sound maker;

a sound analyzer, that receives the at least one sound signal and determines whether a response should be made to the sound and receives the distance determination and determines a suitable response based on the distance; and a responsive element that performs a physical response, responsive to the determinations made by the sound analyzer.

In a preferred embodiment of the invention, the sound analyzer determines the amplitude of the sound and determines a physical response, responsive to the amplitude.

There is also provided in accordance with a preferred embodiment of the invention, apparatus comprising:

a sound-maker which produces a sound when moved;

at least one device comprising:

a sound receiver that receives the sound and produces at least one sound signal responsive thereto;

a sound analyzer, that receives the at least one sound signal and determines whether a response should be made to the sound and determines a suitable response based on an amplitude of the sound; and a responsive element that performs a physical response, responsive to the determinations made by the sound analyzer.

In a preferred embodiment of the invention, the analyzer determines a rate of sound production and wherein the at least one device responds differently to different rates.

There is also provided in accordance with a preferred embodiment of the invention, apparatus comprising:

a sound-maker which produces a sound when moved;

at least one device comprising:

a sound receiver that receives the sound and produces at least one sound signal responsive thereto;

a sound analyzer, that receives the at least one sound signal and determines whether a response should be made to the sound and determines a rate of sound production; and a responsive element that performs a physical response, responsive to the determinations made by the sound analyzer.

In a preferred embodiment of the invention, the sound maker produces a characteristic sound and wherein the analyzer makes its determination responsive to a characteristic of the received sound.

Preferably, the characteristic is pitch.

In a preferred embodiment of the invention, at least one device comprises at least one toy. Alternatively or additionally, at least one device comprises at least one electrical appliance. Alternatively or additionally, at least one device comprises at least one lighting device. Alternatively or additionally, at least one device comprises a plurality of devices. Alternatively or additionally, the apparatus comprises a plurality of devices and a plurality of sound makers, each having a characteristic sound, wherein there is a one to one correspondence between the sound makers and the devices and wherein each device responds only to a sound generated by its corresponding sound-maker.

In a preferred embodiment of the invention, the apparatus comprises a single multifunctional device and a plurality of sound-makers, each having a characteristic sound, wherein the single device responds with a specific function to each of specific sounds characteristics of the sound makers.

In a preferred embodiment of the invention, the apparatus comprises a single multifunctional device capable of determining a sound source parameter, wherein the single device responds with a specific function to different values of parameters.

Preferably, the parameter comprises a source direction.

In a preferred embodiment of the invention, the sound comprises ultrasound frequencies. Alternatively or additionally, the sound comprises infra-sound frequencies.

BRIEF DESCRIPTION OF THE DRAWINGS

The invention will be more clearly understood with reference to the following detailed descriptions of non-limiting preferred embodiments of the invention in which.

DETAILED DESCRIPTION OF PREFERRED EMBODIMENTS

Figure 1:
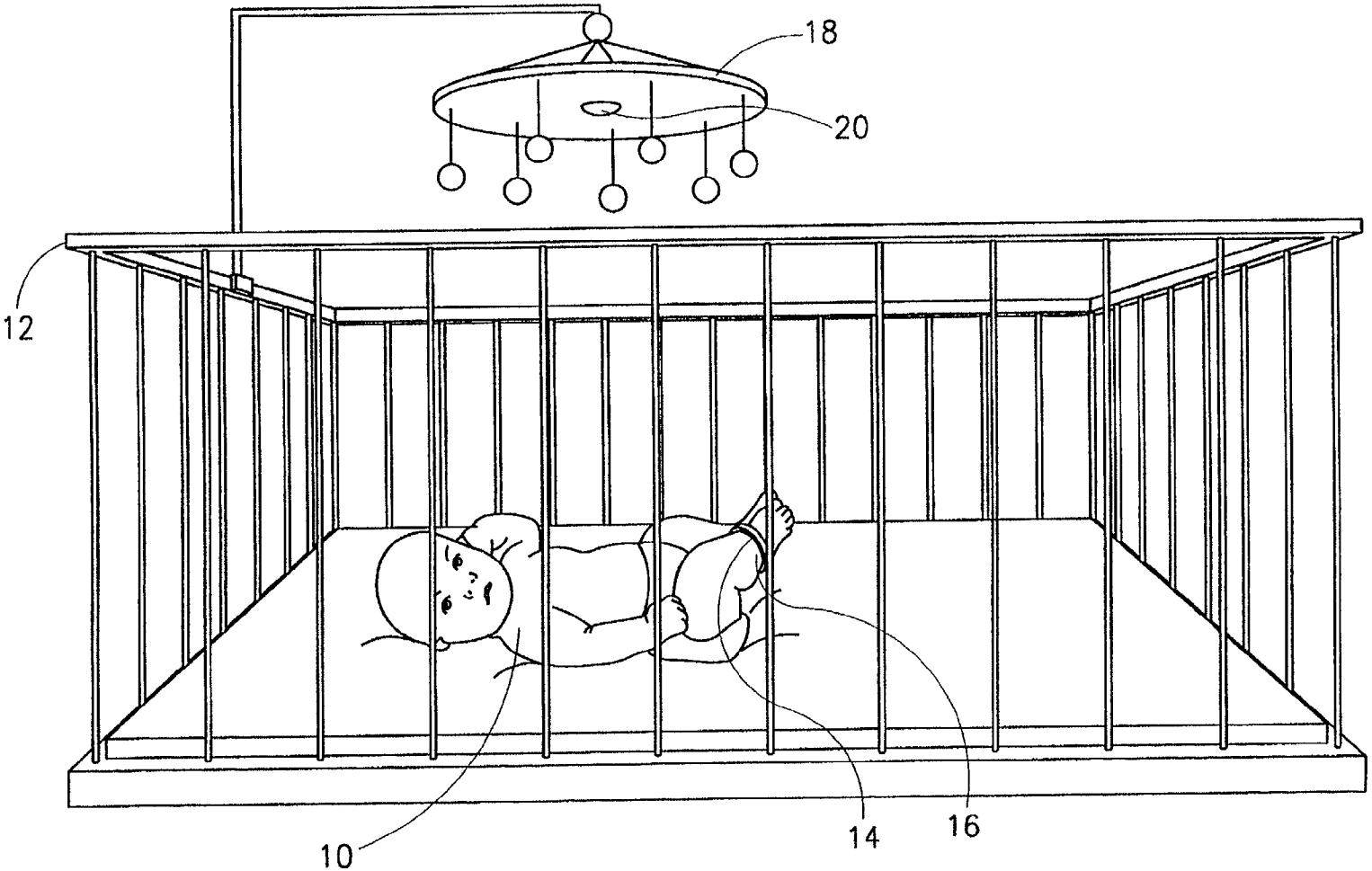
FIG. 1 is a schematic representation of a preferred embodiment in accordance with some aspects of the present invention, illustrating an infant too young for motor control operating at least one toy by incidental sounds produced from a sound maker worn by him, such as a rattle anklet.

FIG. 1 illustrates an infant 10, preferably one too young for fine motor control, who operates at least one toy about his crib 12, utilizing apparatus in accordance a preferred embodiment of the invention. Infant 10 controls the at least one toy with incidental sounds produced by a sound maker such as a rattle anklet 14 worn on his ankle 16. An exemplary toy near crib 12 is a battery-operated mobile 18 comprising a microphone 20.

As infant 10 waggles his legs, the rattle sounds are picked up by microphone 20 of mobile 18, and mobile 18 begins to play. Preferably, mobile 18 plays for a specific duration each time the rattle sounds turn it on. Preferably, mobile 18 circuitry ignores sounds of rattle anklet 14 made while mobile 18 plays.

In a preferred embodiment of the invention, mobile 18 has a frequency-band filter tuned to the frequency of sound made by rattle anklet 14, such that mobile 18 responds only to sounds coming from rattle anklet 14.

In some preferred embodiments mobile 18 has several tunes in its memory and responds to different rates of rattling differently. For example, mobile 18 may play a fast tune in response to a fast rattling rate, and a slow tune in response to a slow rattling rate.

In some preferred embodiments mobile 18 has several tunes in its memory and responds to different rattling amplitudes differently. For example, mobile 18 may play a loud tune in response to a loud rattle and a soft tune in response to a soft rattle.

Figure 2:
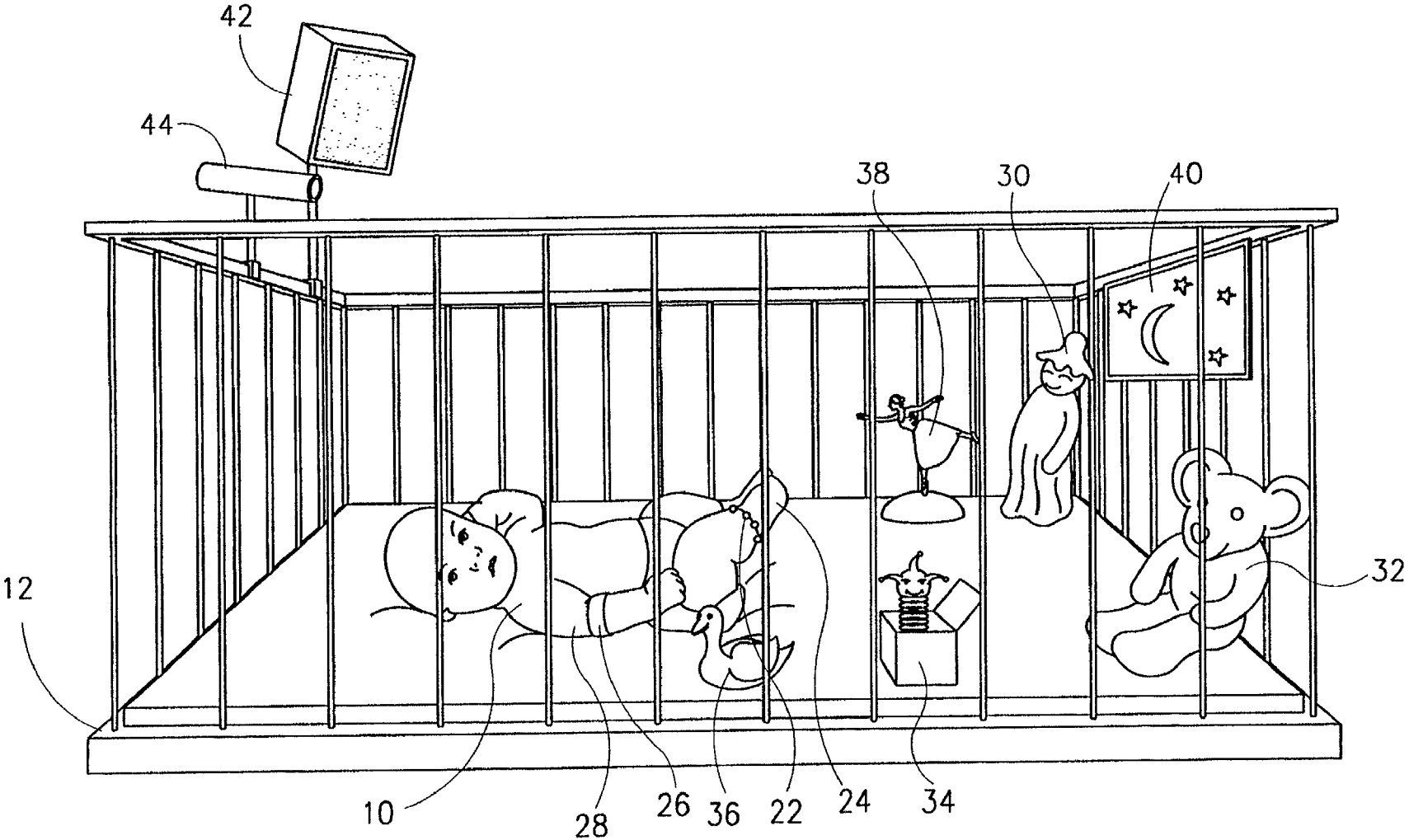
FIG. 2 is a schematic representation of a preferred embodiment in accordance with some aspects of the present invention, illustrating an infant too young for motor control operating a plurality of toys by incidental sounds produced from sound makers worn by him, such as a rattle anklet and a rattle bracelet.

FIG. 2 illustrates infant 10 operating a plurality of battery-operated toys and devices at or near crib 12, in accordance with a preferred embodiment of the invention. Infant 10 controls the plurality of toys and devices with incidental sounds produced by sound-makers worn by him or attached to him, such as socks with sewn-on bells 22, worn on his feet 24, and a pressure sensitive bracelet 26, worn on his arm, close to his elbow 28. (As infant 10 bends his arm, bracelet 26 produces a sound.) Some toys are controlled by socks 22 and some by bracelet 26.

The plurality of battery-operated responding toys and devices in crib 12 may comprise, for example, a doll 30 that makes a giggling sound, a teddy bear 32 that hums a soft tune as if to itself, a "Jack-in-a-box" 34 that jumps up and/or sways to sounds produced from one of the sound-makers of infant 10, a bird 36 that chirps, a ballerina on a music box 38 that reels to the music of its music box, a moon-and-star-studded placard 40 that plays a tune, a music system 42 that plays a tune and/or a display of lights 44. In a preferred embodiment of the invention, music system 42 includes a light show. In one embodiment, the light show comprises one or more moving patterns, which are preferably projected on a ceiling or a wall using laser and/or collimated light patterns. Preferably, the patterns turn on, move, vibrate and/or change in response to the sounds of one of the sound maker of infant 10. Preferably, the light display is accompanied by music from music system 42.

Preferably, not all these toys are placed near or at crib 12 simultaneously. Rather, two or at most three toys are placed in crib 12 each time, and they are replaced from time to time.

Figure 3:
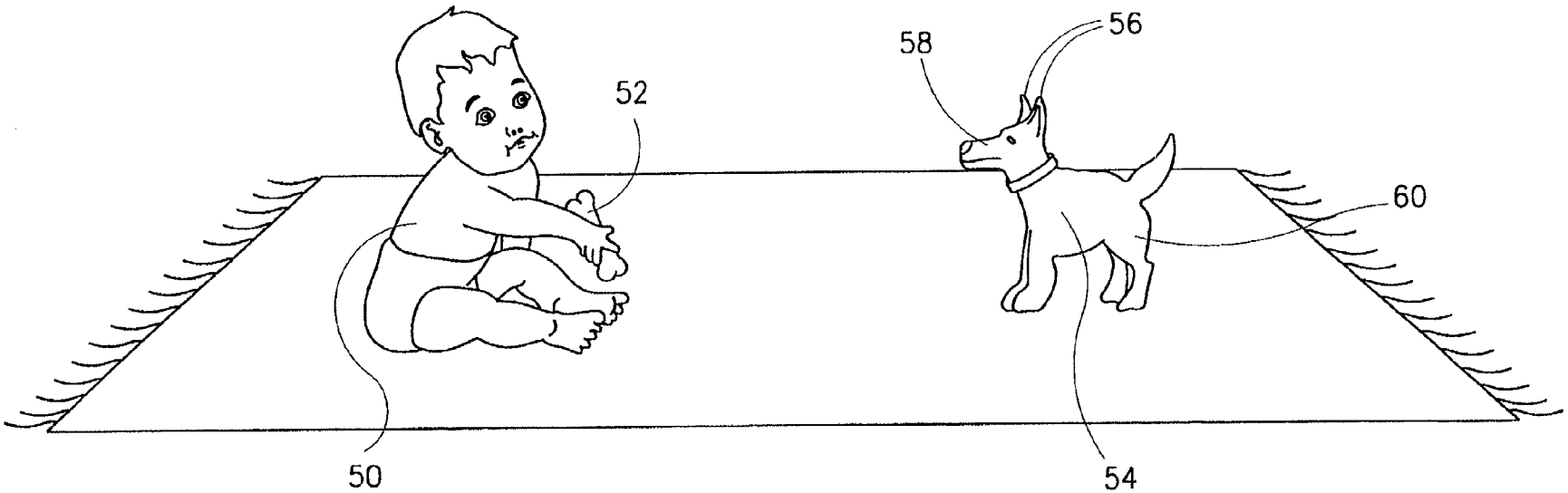
FIG. 3 is a schematic representation of a preferred embodiment in accordance with some aspects of the present invention, illustrating a child playing with a sound-making toy, wherein a toy responding to the sound-making toy has a angle-dependent receiver that is sensitive to the direction of the sound and responds by turning its head to the direction of the sound and/or by walking towards the sound.

Reference is now made to FIG. 3 which is a schematic representation of another preferred embodiment in accordance with some aspects of the present invention. FIG. 3 illustrates child 50 playing with at least one pair of a sound-making toy and a responding toy. For example, the sound-making toy may be a toy rattle bone 52, and the responding toy may be a battery-operated, motorized puppy 54. Preferably, rattle bone 52 is made as a hollow rigid toy of plastic in a shape of a bone preferably with marbles inside to make the rattling sound. In a preferred embodiment of the invention, toy puppy 54 includes a receiver 56 which differentiates between sounds arriving from different directions. In one embodiment, signals from two or more microphones may be combined to yield stereophonic detection. Alternatively or additionally, a microphone having an angular dependence reception may be used. In one example, the amplitude is dependent on the direction. Alternatively or additionally, the relative amplitudes of different frequencies is dependent on the direction. As used herein, direction may include horizontal directions and/or vertical directions. Preferably, head 58 of toy puppy 54 can turn independently. As child 50 rattles rattle bone 52, head 58 turns towards it. In some preferred embodiments, legs 60 of puppy 54 are also segmented at their joints and puppy 54 walks towards rattle bone 52. Preferably, the moving mechanism of toy puppy 54 is capable of moving forward and backward and turning a fixed degree to the left or to the right. Where greater turns are required, toy puppy 54 may turn in several steps, as follows: turn, sense direction of incoming sound, turn further, sense direction of incoming sound, until the turn is complete. Alternatively, the moving mechanism of toy puppy 54 is capable of moving forward and backward and turning a variable degree to the left or to the right, so that a complete turn may be performed in one step. It should be pointed out that the invention is not limited to a toy puppy and any toy having a head and/or limbs such as a toy doll, a toy monkey, a toy ostrich, a to donkey or any other animal toy, as known in the art, may be used. Alternatively or additionally, other external appendages may respond, for example a rider mounted on a horse may wave. Alternatively or additionally, internal portions of the toy may respond, for example, eye of the toy may open and close and/or turn in a direction of a sound source.

Figure 4:
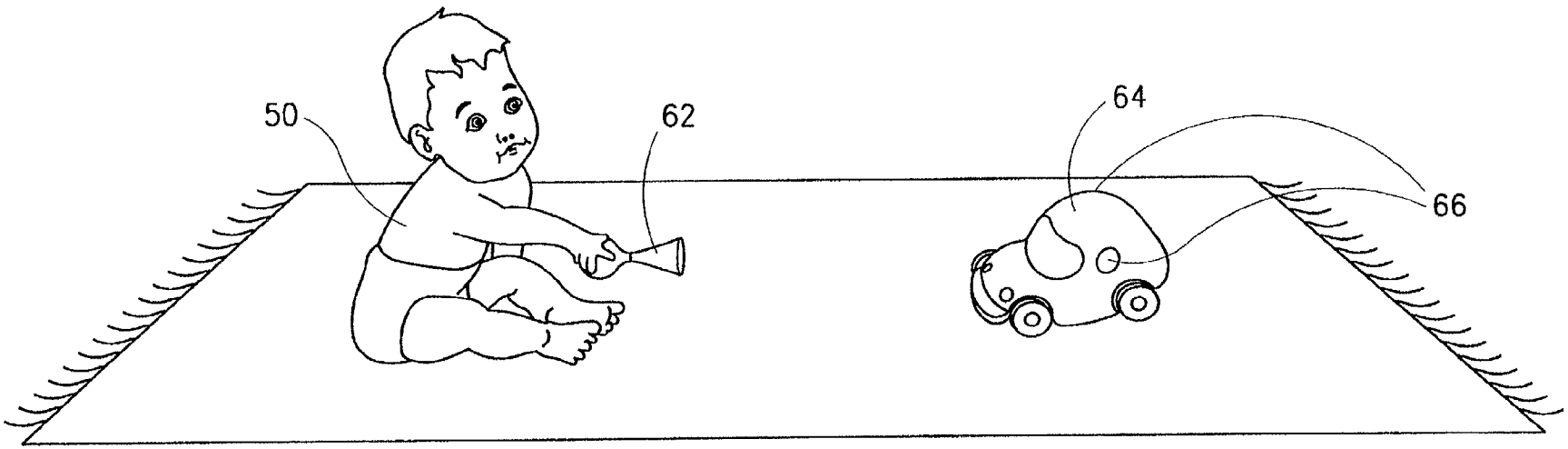
FIG. 4 is a schematic representation of a preferred embodiment in accordance with some aspects of the present invention, illustrating a child playing with a sound-making toy, wherein a toy responding to the sound-making toy has a angle-dependent receiver that is sensitive to the direction of the sound and wheels and responds by wheeling over towards the sound.

FIG. 4 illustrates child 50 playing with another pair of a sound-making toy and a wheeled responding toy. For example, the sound-making toy may be a toy car horn 62 and the responding toy may be a battery-operated, motorized car 64. Preferably, toy car horn 62 is a rubber button that squeaks when pressed. Alternatively toy car horn 62 may be an old-fashioned bicycle blow horn. Preferably, toy car 64 include a direction detection circuitry 66, for example as described with reference to FIG. 3. Preferably, when child 50 presses horn 62, car 64 wheels over towards him or away from him. Preferably, the moving mechanism of toy car 64 is capable of moving forward and backward and turning a fixed degree (such as 10°) to the left or to the right. Where greater turns are required, toy car 64 will preferably turn in several steps. Alternatively or additionally, the moving mechanism of toy car 64 is capable of moving forward and backward and turning a variable degree to the left or to the right, so that the complete turn is performed in one step. It should be pointed out that the invention is not limited to a toy car, and any other toys on wheels, such as a truck, a train, a tractor, a motorcycle, a tractor and others as known in the art, as well as treaded toys such as a treaded tractor or a treaded robot and other treaded toys, as known in the art, may be advantageously used.

Alternatively or additionally, other motion mechanisms, besides wheels and legs may be controlled in response to the sounds, for example, crawling, swimming and rolling. In one example, a rolling ball may comprise an inner ball mounted on gimbals in an outer ball. The inner ball is preferably weighted so that it maintains a fixed orientation relative to the Earth. When the ball is to move in a certain direction, a motor, preferably in the inner ball rotates the inner ball against the outer ball in a desired direction, so that the ball advances in the desired direction.

Figure 5:
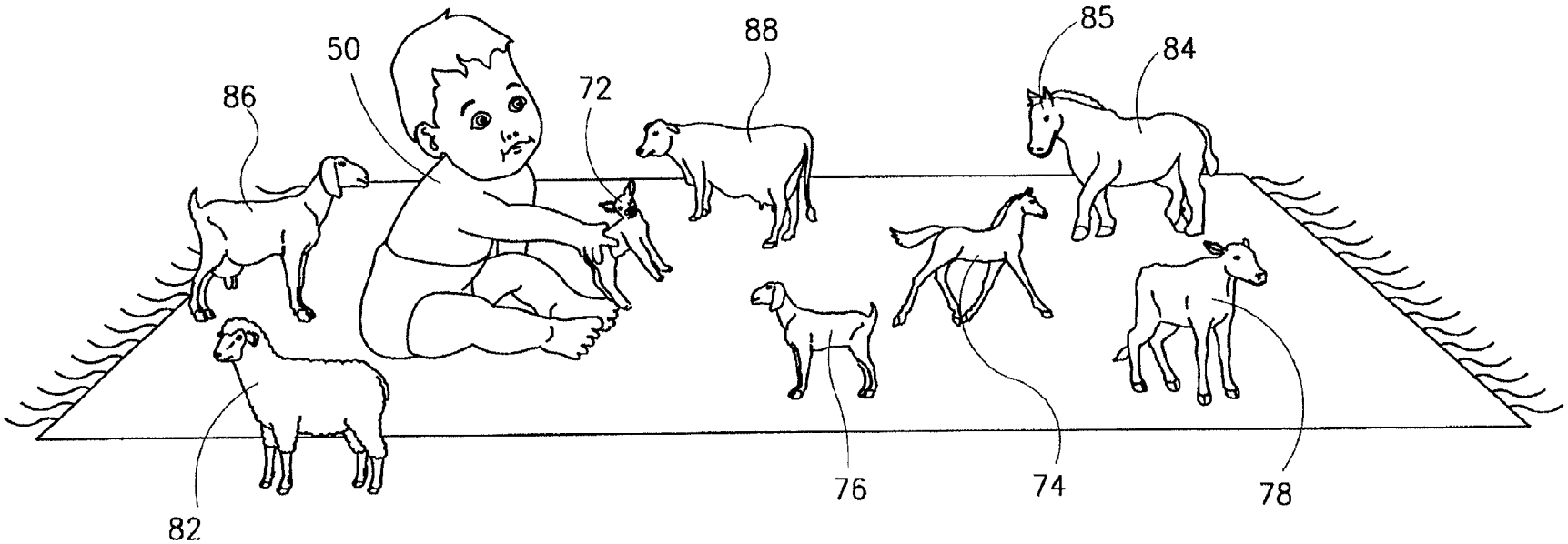
FIG. 5 is a schematic representation of a preferred embodiment in accordance with some aspects of the present invention, illustrating a child playing with a plurality of sound-making toys, wherein a plurality of corresponding responding toys, respond to sounds from their sound-making counterpart.

Reference is now made to FIG. 5 which is a schematic representation of another preferred embodiment in accordance with some aspects of the present invention. FIG. 5 illustrates child 50 and a plurality of pairs of sound-making toys and corresponding responding toys about him. Each sound-making toy has a distinct pitch or sound pattern, and each responding toy has a hidden microphone and a sound analyzer so as to respond to the specific pitch or sound pattern of its corresponding sound-making toy. For example, the plurality of sound-making toys may comprise baby animals that squeak, each with a distinct sound. Preferably, these include a toy lamb 72, a toy colt 74, a toy goat kid 76 and a toy calf 78. The plurality of responding toys may comprise battery-operated mother animals, each having an audio output. Preferably, these include a toy sheep 82, a toy horse 84, a toy goat 86 and a toy cow 88. As child 50 plays and produces sounds with toy lamb 72, toy sheep 82 calls out to her baby. Similarly, as child 50 plays and produces sounds with another toy baby, its mother calls out for it.

In some preferred embodiments, the toy mothers comprise a direction detection circuitry, for example as described with reference to FIG. 3. Alternatively or additionally, the toys include articulating limbs and/or heads, for direction responsive responses, for example as described with reference to FIG. 3. For example, as toy colt 74 produces sounds, toy horse 84 turns its head 85 towards her colt, as well as calls out. Alternatively, toy horse 84 may advance towards its baby.

With regard to the preferred embodiments of FIGS. 3, 4, and 5, the invention is not limited to the specific pairs of toys described. Other pairs of sound-making toys and responding toys may be advantageously used. For example, a sound-making human baby doll, and a battery-operated mother doll with an audio output, a sound-making love bird and a responding battery-operated mate which sings, a sound producing baby bottle that squeaks, and a baby doll that crawls towards it, preferably with an audio output. Many other combinations will occur to persons skilled in the art.

Figure 6:
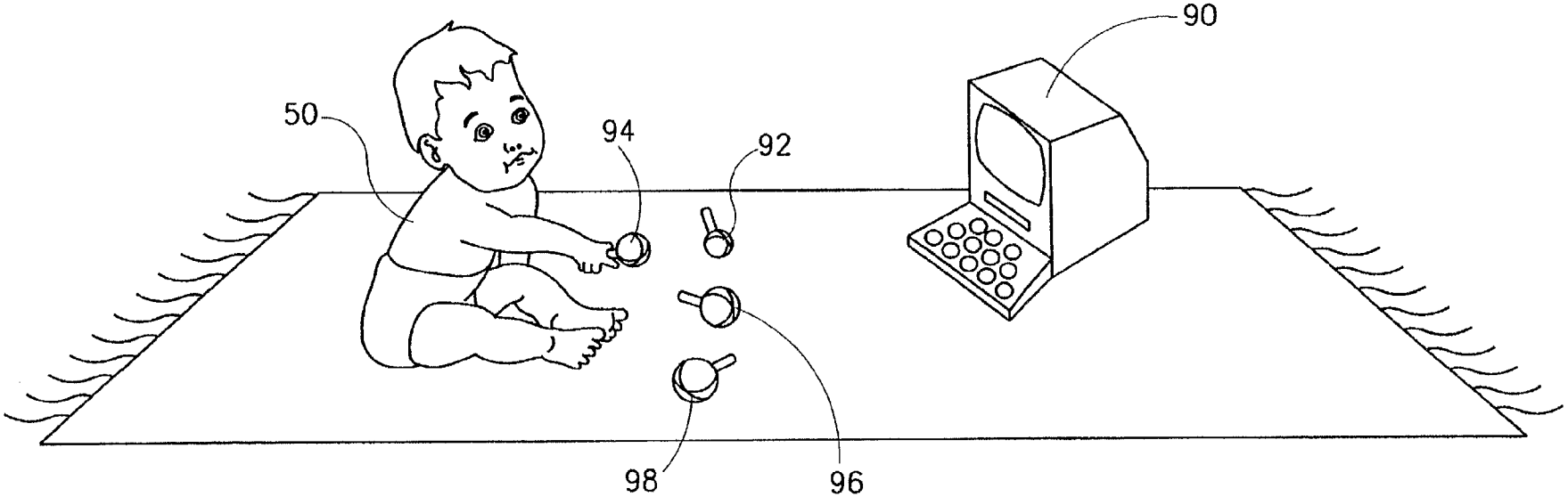
FIG. 6 is a schematic representation of a preferred embodiment in accordance with some aspects of the present invention, illustrating a child playing with a toy computer, using a plurality of sound-making toys as his function keys.

Reference is now made to FIG. 6 which illustrates an alternative embodiment of the invention. FIG. 6 illustrates child 50 playing with a toy computer 90 and with several sound-making toys about him, each capable of generating a distinct sound, wherein the sound-making toys operate activate functions of toy computer 90. For example, the sound-making toys may be different-type rattles. In a preferred embodiment of the invention, when child 50 plays with rattle 92, toy computer 90 responds, for example by flashing in many colors. Preferably, the rate of flashing and the intensity vary with the rate of rattling and its intensity. Alternatively or additionally, toy computer 90 plays a musical tune. Preferably, the toy computer has several tunes stored in its memory, and plays a different tune and/or modulates the tune (e.g. fast, slow, loud or soft), depending on the rattle sound. Alternatively or additionally, the tune is elected to match audio characteristics of the sound and/or of an object represented by the rattle (i.e. a cow shaped rattle). Alternatively or additionally, toy computer 90 displays a short cartoon script responsive to the sound, for example different scripts for different rattles.

In a preferred embodiment of the invention, toy computer 90 comprises a play station (or a suitably programmed computer) executing an interactive game. Preferably, the computer detects parameters of the sounds and the interaction is made responsive to the sound. In one example, a spaceship on the computer screen may move to the same direction as that which the sound is coming from (e.g. up, down left or right). In another example, the control may be responsive to the sound amplitude and/or rate of change of location. Alternatively or additionally, certain activities, for example firing a missile (corresponding to pressing a fire button) may also be performed in response to particular sounds. In another example, the direction of motion is dependent on the type of sounds, with four sound makers preferably being provided to allow four control directions.

In one embodiment of the invention, sound-making toys 92, 94, 96 and 98 may be battery-operated beepers, each having a distinct pitch and/or beeping pattern. In some preferred embodiments, the amplitude of the beeps is made responsive to a pressure applied to a beep button (which works like an organ key). Toy computer 90 may respond to the different pitches, patterns, and sometimes also amplitudes of the beeps with different functions.

The invention is not limited to the particular computer functions described. Other toy computer functions, as known in the art, may be advantageously employed.

Figure 7:
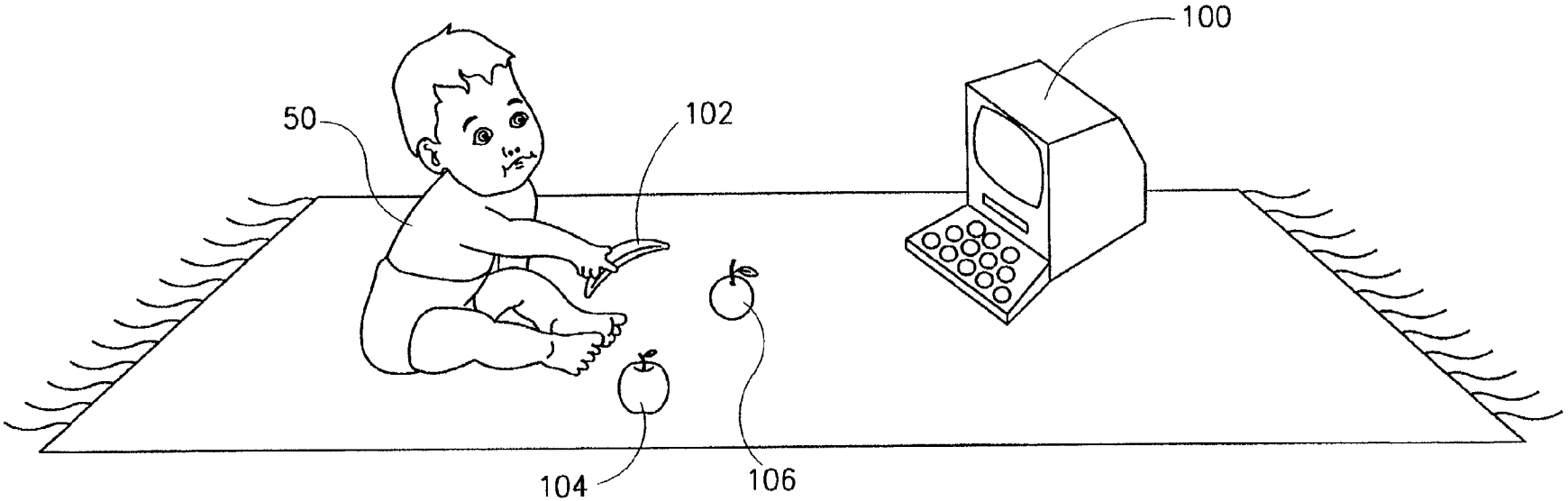
FIG. 7 is a schematic representation of a preferred embodiment in accordance with some aspects of the present invention, illustrating a child playing with a toy computer wherein as he plays with a particular sound-making toy, the toy computer pronounces its name.

Reference is now made to FIG. 7 which is a schematic representation of another preferred embodiment in accordance with some aspects of the present invention. FIG. 7 illustrates child 50, playing with a toy computer 100 and with several sound-making toys about him, each having a distinct sound. For example, the sound-making toys may be toy fruits that squeak. As child 50 picks up a toy banana 102 and squeaks it, toy computer 100 pronounces the word "banana". As child 50 picks up a toy apple 104 and squeaks it, toy computer 100 pronounces the word "apple". As child 50 picks up a toy orange 106 and squeaks it, toy computer 100 pronounces the word "orange".

Alternatively or additionally to vocalizing, toy computer 100 may display a picture representative of the squeaked toy.

Alternatively, toy computer 100 displays a picture of a person pronouncing the names of the toys.

Alternatively, a smart doll may be used in place of toy computer 100 to pronounce the names of the toys.

Alternatively, a "wise" toy animal such as a toy parrot may be used to pronounce the names of the toys.

Alternatively, toy computer 100 may be embedded in a different type of stuffed animal and/or other types of toys, for example vehicles.

Alternatively or additionally, several responding toys, for example, a teddy bear, a toy parrot and a doll may be used, to pronounce the name of the toys. Possibly, each toy may respond only to some of the squeakers, for example, a seal will respond to a fish but not to a banana.

The invention is not limited to the pronouncement of the names of the three toy of FIG. 7, nor is it limited to pronouncing fruit names. Other sound-making toys, as known in the art, may be advantageously named. Alternatively or additionally, other words may be vocalized in response to toys, for example the phrase "please kiss the baby" may be vocalized by a "mother" doll in response to a "baby" doll being squeezed.

In some preferred embodiments the sound-making toys may trigger responses from several responding toys. For example, the sound-making baby animal toys described in the preferred embodiment of FIG. 6 to trigger responses from mother animals, may also be used in preferred embodiments described in FIG. 7 to trigger responses from toy computer 100, or from some other name pronouncing toy.

Figure 8:
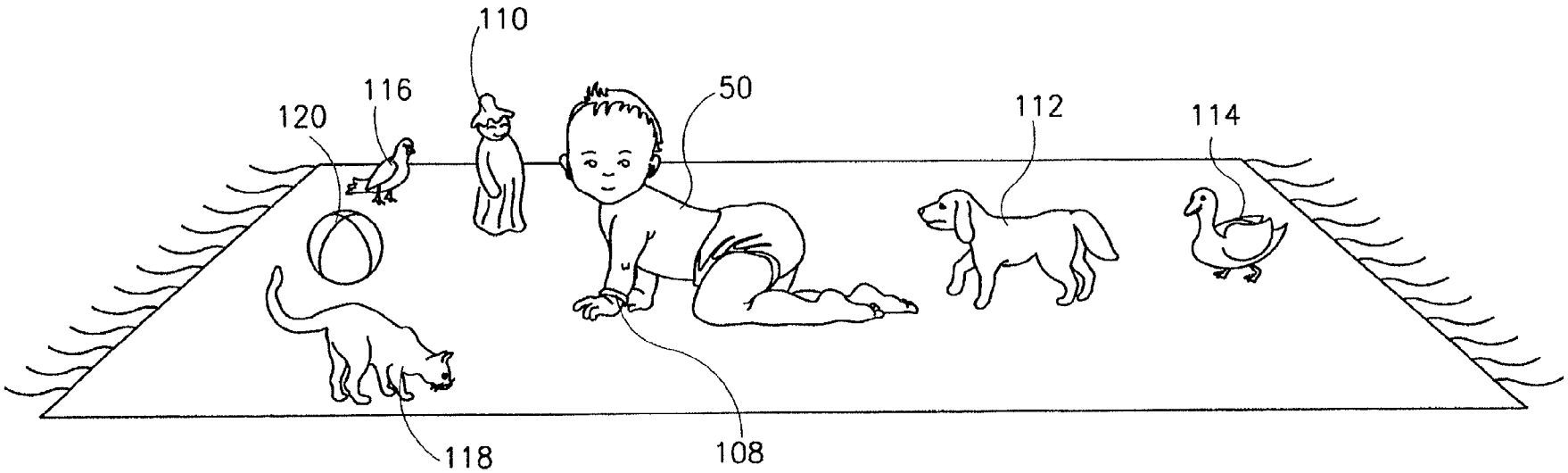
FIG. 8 is a schematic representation of a preferred embodiment in accordance with some aspects of the present invention, illustrating a child crawling through the house with a sound-maker, such as a rattle, attached to his person, wherein a plurality of responding toys respond to his coming and going in a variety of ways.

Reference is now made to FIG. 8 which is a schematic representation of another preferred embodiment in accordance with some aspects of the present invention. FIG. 8 illustrates child 50 crawling about the house. Attached to his person is a sound maker such as a rattle bracelet 108. As child 50 crawls about the house, a plurality of responding, battery-operated toys and devices respond to his coming and going. For example, doll 110, which has appropriate circuitry for discerning if a sound source is approaching or moving away, says, "Hello," as child 50 approaches, and "See you later," as he crawls away. An "I-am-always-behind-you" toy puppy 112, having a receiver that is sensitive to the direction of the sound, a motor, a head and limbs that are preferably segmented at their joints and appropriate circuitry to analyze the direction and speed of child 50, follows child 50 wherever he goes. A toy duckling 114, similarly structured, but with an audio output, comes forward to greet child 50 with a quack. A toy bird 116 chirps as child 50 passes by. A toy cat 118 purrs as child 50 approaches, and meows as child 50 moves away. "A chase-me" ball 120 rolls away from child 50. As child 50 speeds up and tries to catch it, the ball preferably rolls away faster. Sometimes they form a procession, with ball 120 leading the way, child 50 chasing it, puppy 112 following child 50 and last in the procession, duckling 114 waddling and quacking. It should be pointed out that the "chase-me" toy need not be a ball, and any other moving toy such as a toy ostrich, a toy rabbit, a toy car, a toy tractor, and any other moving toy, as known in the art, may be advantageously used.

Figure 9:
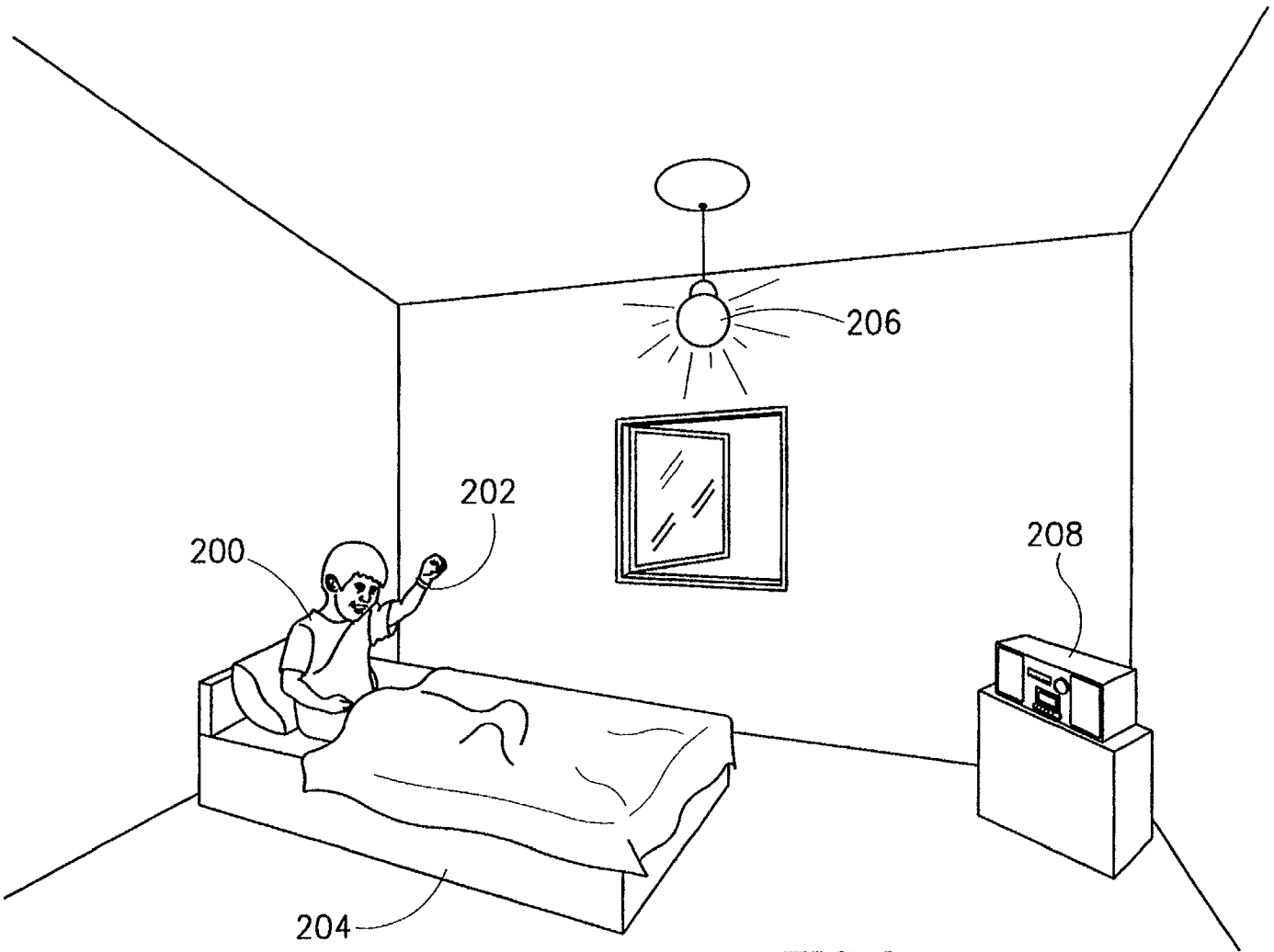
FIG. 9 is a schematic representation of a preferred embodiment in accordance with some aspects of the present invention, illustrating a child who wakes up late at night and relies on a sound maker on his person to turn on the lights and some soothing music for him.

FIG. 9 illustrates an alternative group of applications in which sounds are used to control household devices, in accordance with a preferred embodiment of the invention. FIG. 9 illustrates a child 200 who goes to sleep with a sound maker such as a soft rattle bracelet 202 by his bed 204. One or more devices in the house, for example, one or more lights 206 or a music system 208 include microphones and appropriate circuitry to determine if a sound source is approaching or going away and how far it is, and respond accordingly. If child 200 wakes up in the night, he needs only put on his soft rattle bracelet 202. In a preferred embodiment of the invention, soft rattle 202 may turn on lights 206 and/or music system 208, preferably in the room. Alternatively or additionally, lights outside the room may be turned on, for example, if child 200 walks to the bathroom, the lights in the corridor and in the bathroom will turn on. If he wants a drink of water, and walks to the kitchen, the kitchen light will turn on. As child 200 returns to the room, the house lights will turn off.

Figure 10:
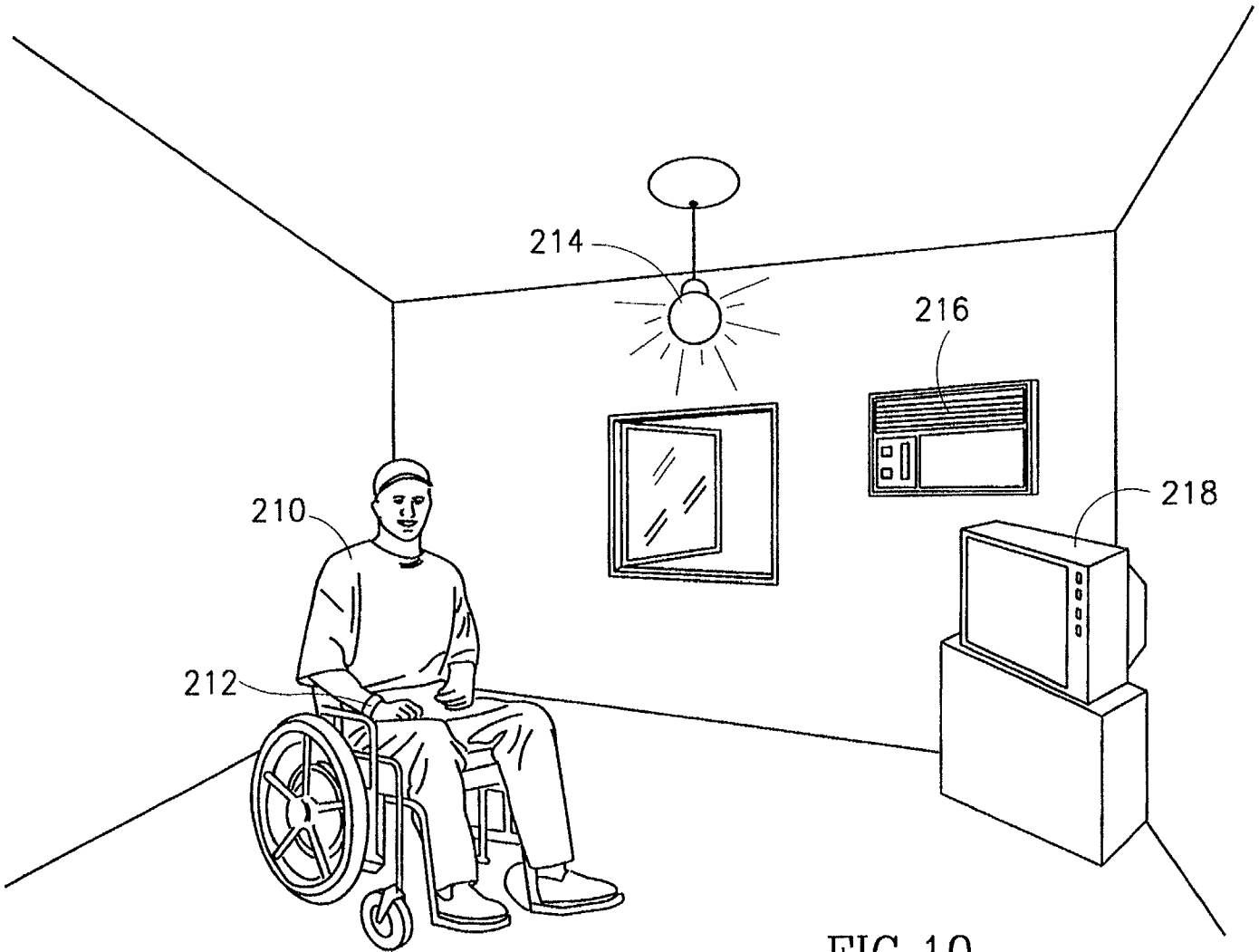
FIG. 10 is a schematic representation of a preferred embodiment in accordance with some aspects of the present invention, illustrating an invalid wearing a sound maker so that, as he enters a room, various electrical devices are turned on for his convenience.

FIG. 10 illustrates an invalid person 210 wearing a sound-making bracelet 212 on his wrist. In a preferred embodiment of the invention, one or more devices in the house include microphones and sound analyzers to detect and analyze sounds from sound maker 212 and respond accordingly. Preferably, the sound analyzers discern if sound maker 212 is approaching or going away and/or a distance to sound maker 212. For example, lights 214, an air conditioner 216 and a TV 218 are turned on as invalid person 210 enters a room, and lights 214, air conditioner 216 and TV 218 are turned off as invalid person 210 leaves the room.

In some preferred embodiment, a plurality of sound-makers is available for different times of the day and for different seasons. For example, on a winter night, invalid person 210 will have on him a sound-maker that will turn on lights, a heater, and a television. But during a summer day, invalid person 210 will have on him a sound-maker that will turn on an air-conditioner or a fan and a music system, or a computer. Alternatively or additionally, the sound responsive devices may be programmed to respond differently depending on time of day and/or date.

Figure 11:
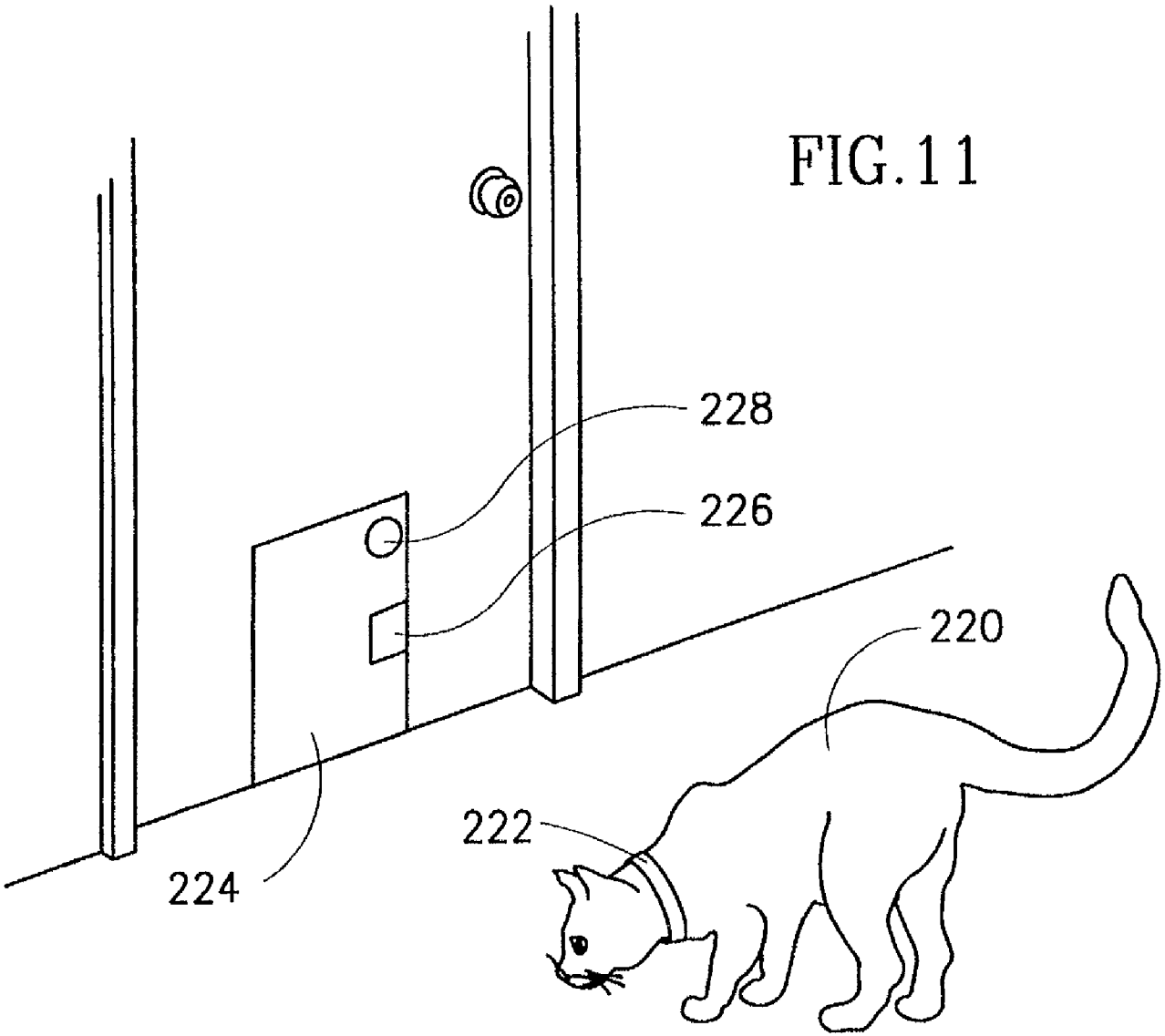
FIG. 11 is a schematic representation of a preferred embodiment in accordance with some aspects of the present invention, illustrating a pet wearing a sound maker and thereby controlling a pet door that has an electric lock.

FIG. 11 illustrates a pet 220 wearing a sound-making collar 222. Pet 220 can let itself in and out of a pet spring door 224 that is locked with an electric lock 226. Preferably, pet door 224 has a microphone 228 and a sound analyzer to senses the approach of the pet and opens lock 226, responsive to the sound. Preferably, as pet 220 approaches door 224, electric lock 226 opens. As pet 220 moves away from the door, lock 226 shuts.

Figure 12:
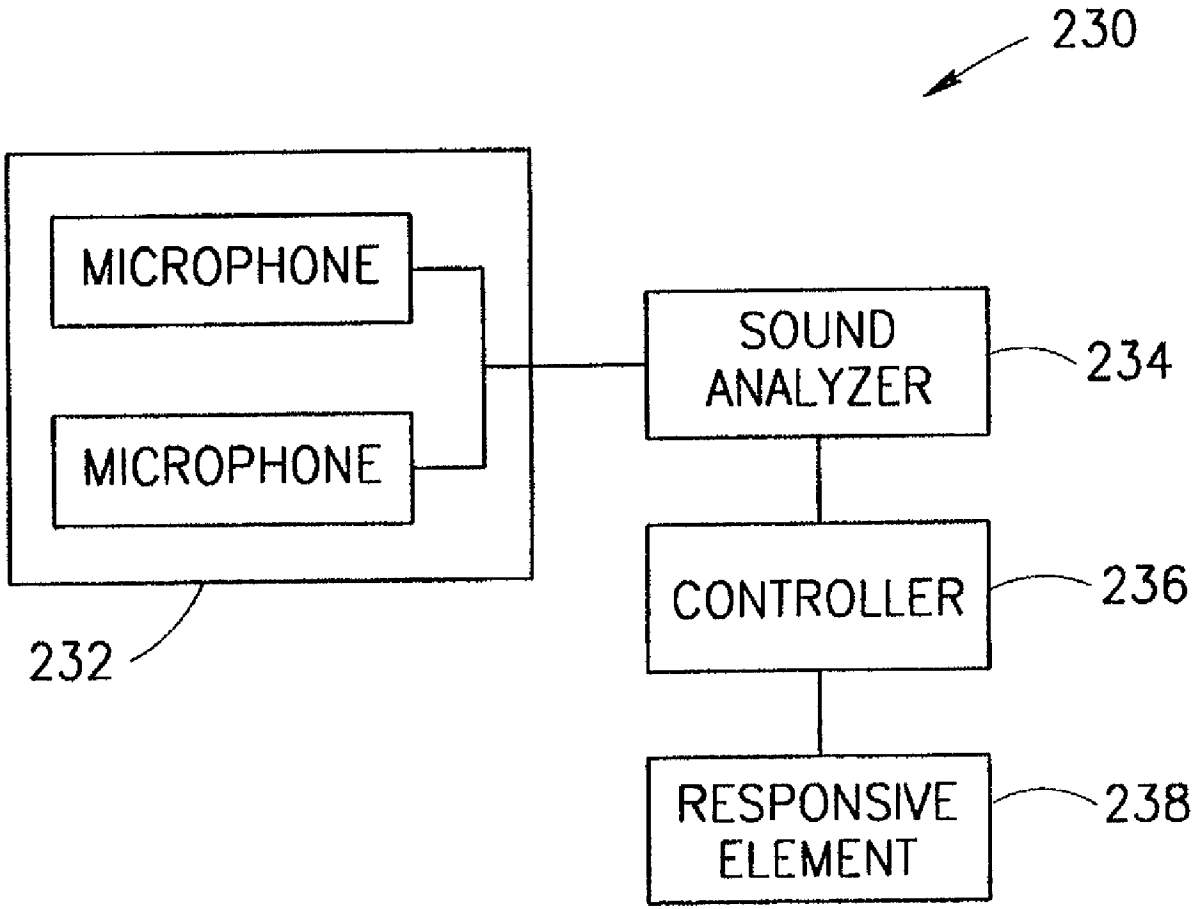
FIG. 12 is a schematic representation of some preferred embodiment in accordance with some aspects of the present invention, illustrating in a block diagram the manner of operation of the toys and devices described here.

Reference is now made to FIG. 12 which is a schematic representation of the manner of operation of preferred embodiments of the invention, by a block diagram 230. Block diagram 230 comprises four basic components: a receiving component 232, a sound analyzer 234, a controller 236, and a responsive element 238.

Receiving component 232 may comprise a single receiver, a stereo (or quadrate) receiver, or a receiver comprising a single microphone that has an angular dependence. Such a receiver may be able to determine one or two angular axes of orientation. Alternatively or additionally, sound analyzer 234 may be able to determine one, two or three-dimensional position in space. Preferably, the determinations are of cylindrical coordinates (i.e., pitch, yaw and distance).

Sound analyzer 234 and controller 236 may be embodied in a single unit, for example in a microprocessor. In a preferred embodiment of the invention, the sound frequencies are selected to be in relatively noise free frequency bands. Alternatively or additionally, the frequency is above 10 kHz. Alternatively or additionally, the frequency is above 12 kHz. Sound analyzer 234 preferably includes a band-pass filter for these frequencies. Preferably, the filter is at an entrance to sound analyzer 234, so that most of sound analyzer 234 does not draw power when an "out of band" sound is received by receiver 232. Preferably, sound analyzer 234 includes a noise filter for rejecting sounds at levels similar to and/or below ambient sound levels. Preferably sound analyzer 234 self-calibrates by determining ambient sound levels when it is first turned on and/or if it is not used for a significant period of time.

Responsive element 238 may include a motor for providing a physical response by motion, a speaker for providing a physical response by audio output, a lighting device for providing a physical response by light and an on/off switch. In a preferred embodiment of the invention, controller 236 modulates a supply of power to responsive element 238, to effect the desired response. For example, controller 236 may switch on power to a motor which rotates wheels on a wheeled toy.

As described herein above, sound analyzer may discriminate several different sounds and parameters of these sounds, including different sound sources, sound directions, sound amplitudes, sound pitches, sound motion, preferably by Doppler analysis, distance, preferably utilizing a constant amplitude sound source or by comparing the relative amplitudes of different frequency bands, each of which is differentially attenuated by the atmosphere, motion rate and/or absolute location. In a preferred embodiment of the invention, controller 236 includes a logic element which maintains an internal state and controls responsive element 238 differentially responsive to the state. Thus, different responses and/or magnitude of responses may be affected for a same sound source, depending on the internal state.

In one example, controller 236 includes a state machine. In an example of a "run-away car", a first rattle will make the car move away, a second rattle will make it move faster and a third (and possibly subsequent) rattle will make the car go in circles surrounding the noise source. Alternatively or additionally, the logic may include a functional dependency, for example, the speed of the car may be a function of the sound amplitude. Alternatively or additionally, the logic may include measurements of time, for example the car will start slowing down after 30 seconds and/or will stop and/or flash lights if no sound is detected for 1 minute. Alternatively or additionally, the logic may respond to parameters of the toy, for example battery level and length of time activated. Alternatively or additionally, combinations of the above logics may be provided. In a preferred embodiment of the invention, the toy may include one or more switches, such as dip switches, to select different logics. Alternatively or additionally, the toy may include a memory, for example, the toy determines a distance to a sound maker and then advances that distance, even if the sound maker ceases from creating sounds.

It should be noted that the sound makers of the preferred embodiments of the invention are not limited to rattles, bells, squeaky toys, pressure-sensitive instruments, or battery operated beepers. Other sound makers, such as whistles, thimbles, triangles, small drums and others as known in the art, may be advantageously employed.

In some preferred embodiments the sound maker may be a rattle anklet as described. Alternatively, it may be a rattle bracelet. The anklet or bracelet may have a stretchable band. Alternatively, they may clasp the wrist or ankle, possibly as a soft (cloth coated) spring clip. Alternatively, they fit with a band like that of a wrist watch. In some preferred embodiments, the sound maker may be a pendant. In some preferred embodiments, the sound maker may be sewn onto an article of clothing such as to the infant's socks, to the infant's sleeve or to the infant's pants. In some preferred embodiment the sound maker may be attached to an article of clothing by a safety pin, held by a clip such as a tie clip, hung on a button, or worn as a pin. Alternatively or additionally, the sound maker may include a plurality of hard objects inside a cavity. Alternatively or additionally, the sound maker may include crinkle material. Alternatively or additionally, the sound maker may include tines which generate a substantially single frequency sound.

Preferably, the sounds of the sound makers are pleasant or at least not irksome to people and/or to pets. In some preferred embodiments the sounds of the sound makers are inaudible to humans. In some preferred embodiments the sounds of the sound makers are inaudible to humans as well as to pets. In a preferred embodiment of the invention, inaudible sounds comprise infra sounds, at frequencies below human and/or pet hearing ability. Alternatively or additionally, inaudible sounds comprise ultrasonic sound, above human hearing abilities and/or above pet hearing abilities. Preferably, the terms infra-sound and ultra-sound reflect the hearing abilities of a 20 year old healthy human male. Alternatively, the frequencies may be selected to be outside of a child's hearing range. Alternatively or additionally, the sound frequencies may be selected to suit an older person. In a preferred embodiment of the invention, the sound wave is carried in the atmosphere. Alternatively or additionally, the sound is carried in a liquid, for example in bath toys. Alternatively or additionally, the sound may be carried by solids, for example through a floor.

It should be noted that the invention is not limited to the toys described here. Other toys capable of responding to an electrical signal may be advantageously employed, by modulating the electrical signals responsive to the sounds.

The toys may be activity centers, dolls, toy animals, stuffed animals, toy cars, toy trucks, toy airplanes, toy helicopters, toy trains, toy boats, toy puppets, toy appliances, toy computers, toy music systems, toy cameras, toy TV, toy radios, toy tape players.

The response of the toys may be by sounds, such as in pronouncing a word, a combination of words, crying, laughing, giggling, singing, playing a melody, ringing, whistling, various engine and motor sounds such as of cars, trains, helicopters, airplanes, horn sounds, animal sounds such as the singing of birds, hooting, barking, meowing, purring, mooing, other animal sounds and other sounds in general.

Alternatively or additionally, the response of the toys may be by flashing lights of one or several colors, or by blinking of lights wherein the light source may comprise light bulbs of different kinds, or laser light of one or several colors.

Alternatively, or additionally, the response may be a musical piece.

Alternatively or additionally, the response of the toys may be by movement, such as by a stuffed animal raising its arms, a toy puppy wagging its tail, a Jack in the Box jumping out and swaying, a car running, a robot moving and turning, a toy doll or a toy animal turning its head, moving its arms or walking, a ball rolling.

In some preferred embodiments the sound maker and the responding toy are bought together, for example, a mobile and an rattle anklet that operates it, or a singing moon-and star-studded placard and a rattle bracelet that operates it. In other preferred embodiments the responding toys have a frequency-band filter and a tuning button so that they can be tuned to operate with existing or home made sound makers.

It should be noted that the invention is not limited to the specific electrical appliances and lighting described here turning on and off. Other electrical appliances and electrical systems may be advantageously activated.

The invention described herein is not limited to the particular preferred embodiment described herein, nor for those embodiments, to particular elements described. The limits of the protected invention are defined by the following claims. In the claims, the terms "comprising", "comprises", "including" "includes", or the like means "including but not necessarily limited to."

The invention claimed is:

1. A method of controlling at least one device by incidental sound produced by a living creature, comprising:

attaching a sound-maker to a portion of the living creature;

positioning at least one device which responds to sounds, in a location in which the device senses sounds from the sound maker;

sensing, by the at least one device, sounds from the sound-maker which are caused by movements of the portion of the living creature to which the sound-maker is attached; and responding by a physical response to the sensed sounds, by the at least one device.

2. A method according to claim 1, wherein the movements comprise movements which in the absence of the sound-maker do not generate sounds to which the at least one device responds.

3. A method according to claim 2, wherein the movements comprise movements which in the absence of the sound-maker do not normally generate sounds.

4. A method according to claim 1, wherein the movements comprise movements routinely performed by the living creature even in the absence of the sound-maker.

5. A method according to claim 1 wherein the movements comprise bending of an arm of the living creature.

6. A method according to claim 1, wherein the movements comprise crawling.

7. A method according to claim 1 wherein sensing sounds from the sound-maker comprises sensing sounds which are incidental to the movements.

8. A method according to claim 1, wherein attaching the sound maker comprises attaching the sound maker to clothes worn by the living creature.

9. A method according to claim 1 wherein attaching the sound maker comprises placing the sound marker around an organ of the living creature.

10. A method according to claim 1 wherein attaching the sound maker comprises attaching an anklet or bracelet.

11. A method according to claim 1 wherein attaching the sound maker comprises wearing socks.

12. A method according to claim 1 wherein the sounds caused by the movements are due to movements of the sound-maker.

13. A method according to claim 1, wherein positioning the at least one device comprises positioning the at least one device near the sound maker.

14. A method according to claim 1, wherein positioning the at least one device comprises positioning at least one toy.

15. A method according to claim 1 wherein the at least one device comprises at least one electrical appliance.

16. A method according to claim 1 wherein the at least one device comprises at least one lighting device.

17. A method according to claim 1 wherein the at least one device comprises a plurality of devices.

18. A method according to claim 1 wherein the living creature is a child.

19. A method according to claim 1 wherein the living creature is an infant lacking fine motor control.

20. A method according to claim 10 wherein the living creature is an invalid.

21. A method according to claim 1, wherein the living creature is an animal.

22. A method according to claim 1 wherein responding comprises producing an audio output.

23. A method according to claim 1 wherein responding comprises producing a light display.

24. A method according to claim 1 wherein responding comprises producing a response on a computer screen.

25. A method according to claim 24, comprising controlling at least one element in a computer game responsive to said received sounds.

26. A method according to claim 25, comprising sensing the direction of the sound maker and wherein controlling comprises moving the at least one element responsive to the sensed direction.

27. A method according to claim 1, wherein responding comprises generating motion on the at least one device.

28. A method according to claim 27, wherein generating motion comprises turning a head.

29. A method according to claim 27, wherein generating motion comprises moving eyes.

30. A method according to claim 27, wherein generating motion comprises moving a nose.

31. A method according to claim 27 wherein generating motion comprises moving ears.

32. A method according to 27 wherein generating motion comprises moving a mouth.

33. A method according to claim 1 wherein responding comprises moving the device.

34. A method according to claim 33, wherein moving comprises moving on limbs.

35. A method according to claim 33 wherein moving comprises moving on wheels.

36. A method according to claim 33, wherein moving comprises moving on treads.

37. A method according to claim 33 wherein moving comprises moving at a predetermined angular orientation.

38. A method according to claim 33, wherein moving comprises moving at a variable angle.

39. A method according to claim 1 wherein sensing sounds comprises sensing ultrasounds.

40. A method according to claim 1 wherein sensing sounds comprises sensing infra-sounds.

41. A method according to claim 1 comprising analyzing the sensed sounds for at least one parameter of a distance from the at least one device to the sound maker, whether the sound maker is approaching or moving away, an amplitude of the sounds, a pitch of the sounds and a sound-production rate, and wherein responding by the physical response to the sensed sounds comprises responding differently by the at least one device responsive to the at least one analyzed parameter.

42. A method according to claim 1 wherein sensing sounds comprises stereophonically sensing sounds, and including analyzing the direction of the sensed sounds, wherein responding comprises responding responsive to the analyzed direction.

43. A method according to claim 1, wherein sensing sounds comprises differentially sensing sounds, and including analyzing the direction of the sensed sounds, wherein responding comprises responding responsive to the analyzed direction.

44. A method according to claim 1 wherein the at least one device responds substantially only to sounds having characteristics of the sound maker.

45. A method of controlling at least one device by sound, comprising:

generating a sound;

receiving the sound by the at least one device;

analyzing the received sound for at least one parameter of a distance from the at least one device to a source of the sound, whether the source of the sound is approaching or moving away, an amplitude of the sound and a pitch of the sound; and responding by the at least one device with different physical responses to sounds with different values of the at least one parameter.

46. A method according to claim 45, wherein generating the sound comprises generating the sound by a sound maker.

47. A method according to claim 45, wherein responding by the at least one device with different physical responses comprises responding with a physical response having a changeable value which is a function of the at least one parameter.

48. A method according to claim 45 wherein a living creature causes the sound to be generated.

49. A method according to claim 48, wherein generating the sound comprises generating the sound by movements of the living creature.

50. A method according to claim 45 wherein receiving the sound comprises receiving stereophonically.

51. A method according to claim 45, wherein receiving the sound comprises receiving differentially.

52. A method according to claim 45 wherein the at least one device comprises at least one toy.

53. A sound-controlled device, comprising:

a sound receiver that receives sounds in frequencies inaudible to 20 year old human males but audible to pets, and produces at least one sound signal responsive thereto;

a sound analyzer, that analyzes the at least one sound signal to determine at least one parameter of the sound; and a response element that performs a physical response, responsive to at least some of the analyzed sound signals according to the determined at least one parameter.

54. A device according to claim 53, wherein the sound analyzer determines, for at least some of the received sounds, whether a sound source is approaching or receding using the Doppler effect on the sound frequency of the sound signals.

55. A device according to claim 53, wherein the sound analyzer determines, for at least some of the received sounds, whether a sound source is approaching or receding responsive to a change in amplitude of the sound with time.

56. A device according to claim 53, wherein the response element is included in a toy.

57. A device according claim 53 wherein the sound receiver comprises a stereophonic receiver.

58. A device according claim 53, wherein the sound receiver comprises a differential receiver.

59. A device according to claim 53 wherein the response element is capable of performing a plurality of different responses, and a specific response to the received sound is chosen responsive to the at least one determined parameter.

60. Apparatus for sound control, comprising:

a plurality of sound makers which produce different sounds; and a device according to claim 59, wherein the plurality of different responses are performed responsive to the different sounds of the sound makers, respectively.

61. A device according to claim 53 wherein the sound receiver receives sounds in frequencies within a child's hearing range.

62. A device according to claim 53 wherein the sound receiver receives sounds in frequencies outside a child's hearing range.

63. A device according to claim 53 wherein the response element comprises a computer screen.

64. A device according to claim 53 wherein the response element responds by displaying a display chosen responsive to the determined at least one parameter.

65. A method of controlling at least one device by sound, comprising:

generating a sound;

receiving the sound by the at least one device;

analyzing the received sound for a parameter of a sound production rate of the received sound; and responding by a physical response, which has a speed which is a function of the sound production rate.

66. A method according to claim 65, wherein generating the sound comprises generating the sound by a sound maker and wherein the sound production rate comprises a rate of movement of the sound maker.

67. A method according to claim 65, wherein responding by a physical response comprises moving an object at a speed which is a function of the sound production rate.

68. A method according to claim 65 wherein responding by a physical response comprises sounding a tune which has a speed which is a function of the sound production rate.

* * * * *